US005079408A

United States Patent [19]

Jordan, Jr.

[11] Patent Number: 5,079,408

[45] Date of Patent: Jan. 7, 1992

[54] DRIP PAN

[76] Inventor: W. M. Jordan, Jr., 1253 Augusta St., Montgomery, Ala. 36111

[21] Appl. No.: 619,446

[22] Filed: Nov. 29, 1990

[51] Int. Cl.[5] ..... H05B 3/76

[52] U.S. Cl. ..... 219/461; 219/455; 219/460

[58] Field of Search ..... 219/460, 461, 455; 126/51

[56] References Cited

U.S. PATENT DOCUMENTS

| | | | |
|---|---|---|---|
| 1,107,333 | 8/1914 | Mansfield | 219/460 |
| 1,472,201 | 10/1923 | Woodson | 219/461 |
| 1,514,628 | 11/1924 | Pritzker | 219/461 |
| 1,686,108 | 10/1928 | Shaw | 219/461 |
| 1,706,908 | 3/1929 | Westman | 219/460 |
| 2,532,033 | 11/1950 | Parks | 219/461 |
| 3,987,275 | 10/1976 | Hurko | 219/461 |

*Primary Examiner*—Teresa J. Walberg

*Attorney, Agent, or Firm*—Hurt, Richardson, Garner, Todd & Cadenhead

[57] ABSTRACT

An insulated drip pan assembly for a cooking range including an upper pan and a lower pan between which insulation is sandwiched; the two pans and insulation cooperating together to reduce both the time and energy required to cook food in a cooking vessel located on the range.

5 Claims, 2 Drawing Sheets

DRIP PAN

BACKGROUND OF THE INVENTION

1. Field of the Invention

The present invention relates generally to a drip pan assembly for a cooking range and more specifically to an insulated drip pan assembly for use with a cooking range.

2. Description of Related Art

Drip pans for use with cooking ranges are well known and commonly used. A main function of drip pans is to catch food particles, liquids and other food-related or other matter which may exit a cooking or other vessel placed on the range. The conventional drip pan collects such matter for easy clean-up and to prevent such matter from entering the interior of the range. Drip pans generally are made of a heat conducting material, such as metal, and may be chrome-plated or polished for aesthetic reasons or coated with a non-stick substance to ease removal of drippings.

The typical drip pan's function is to catch drippings and not to participate in the cooking or heating of the food contained in vessels on the range. Therefore, drip pans generally are formed from aluminum or other metals for economical reasons—ease of formation and economy of raw materials. However, these metals generally are heat conducting. A major disadvantage of known drip pans is because heat conducting materials radiate heat in all directions, drip pans do not speed the heating of the cooking vessel atop the heating element. As a result, a portion of the energy which could be used to cook food is wasted.

SUMMARY OF THE INVENTION

The present invention includes a structure allowing the heat radiated downward from a heating element of a cooking range to be redirected upward towards the cooking vessel located on the heating element, thus preventing the waste of such heat and allowing a faster, more energy efficient heating of the cooking vessel. The structure of the present invention comprises an upper pan which is connected to a lower pan in such a manner that an enclosed space or hollow is formed between the upper and lower pans into which insulating material is placed. As heat radiating downward from a heating element of a cooking range contacts the insulating material, it is redirected upwards back toward the heating element, and the cooking vessel located thereon, and can assist in the heating of the cooking vessel. The present invention is intended to replace conventional drip pans and is of a corresponding size and shape for such a retrofit.

The insulated drip pan assembly of the present invention comprises two generally upwardly concave bowl-shaped pans, an upper pan and a lower pan, between which insulation is located or sandwiched. The upper pan faces the heating element of the cooking range and is made of a heat conducting material, such as aluminum. The upper pan is of the same general shape and size as the conventional drip pan and comprises a bowl member to catch drippings, a support flange located on the upper periphery of the bowl member to support the pan in the heating receptacle of the range top, and a central opening in the bottom of the bowl member to allow radiative heat to escape from the area surrounding the oven chamber which generally is located below the range top heating elements. The edges of the support flange and the central opening have generally "C"-shaped lips or ridges which allow the attachment and securement of the lower pan to the upper pan.

The lower pan also is of the same general shape and size as the conventional drip pan, and also comprises a bowl member, a flange, and a central opening. However, the bowl member of the lower pan is somewhat deeper than the bowl member of the upper pan and the conventional drip pan and the lower pan further comprises a horizontal cylindrical sleeve located between the bowl member and the flange. The deeper bowl and the sleeve cooperate to space the lower pan from the upper pan when the two pans are attached together, thus forming a space between the two pans into which insulating material may be placed. The lower pan generally is made of a material which does not conduct heat so as to prevent heat from emanating out of the bottom of the drip pan. Further, the lower pan generally is made of a material which is heat resistant, to withstand the temperatures of a cooking range, yet flexible enough to cooperate in attaching to the upper pan.

The flanges of the two pans extend horizontally from the upper perimeter of the bowl member of the upper pan and the sleeve of the lower pan. These flanges may be attached to each other by any conventional means such as clips or crimping. Generally, the flange of the upper pan comprises a "C"-shaped lip while the flange of the lower pan comprises a flat horizontal lip of such a configuration so as to fit within and cooperate with the "C"-shaped lip of the upper pan and to hold the upper and lower pans together. The central openings of the two pans likewise may be attached to each other, thus creating a generally taurus or donut shaped enclosure between the upper and lower pans into which insulating material may be placed. In this configuration, the insulation located between the upper and lower pans is not exposed to food, liquids or other food-related matter which might exit the drip pan through the central openings.

The insulating material may be any conventional insulator such as fiberglass or asbestos. Preferable insulators are those which can withstand the temperatures generated by a cooking range, are environmentally safe and economical and easy to use.

Accordingly, it is an object of the present invention to provide an insulated drip pan assembly which shortens the time it takes to heat substances.

Another object of the present invention is to provide an insulated drip pan assembly which reduces the amount of energy it takes to heat substances.

Yet another object of the present invention is to provide an insulated drip pan which redirects heat radiated downward from a heating element back upward toward a cooking vessel.

An additional object of the present invention is to provide an insulated drip pan which does not hinder the operation of range-top heating elements or below range-top oven units.

It is a further object of the present invention to provide an insulated drip pan assembly which may be retrofitted easily to existing electric ranges.

Another object of the present invention is to produce an insulated drip pan assembly which is inexpensive to manufacture, durable in construction and efficient in operation.

These objects and other objects, features and advantages will become apparent when the following description is read in conjunction with the accompanying figures.

DETAILED DESCRIPTION OF THE INVENTION

Turning now to the drawings in which like numerals denote corresponding parts throughout the various views, the drip pan assembly of the present invention is denoted generally as 10.

Figure 1:
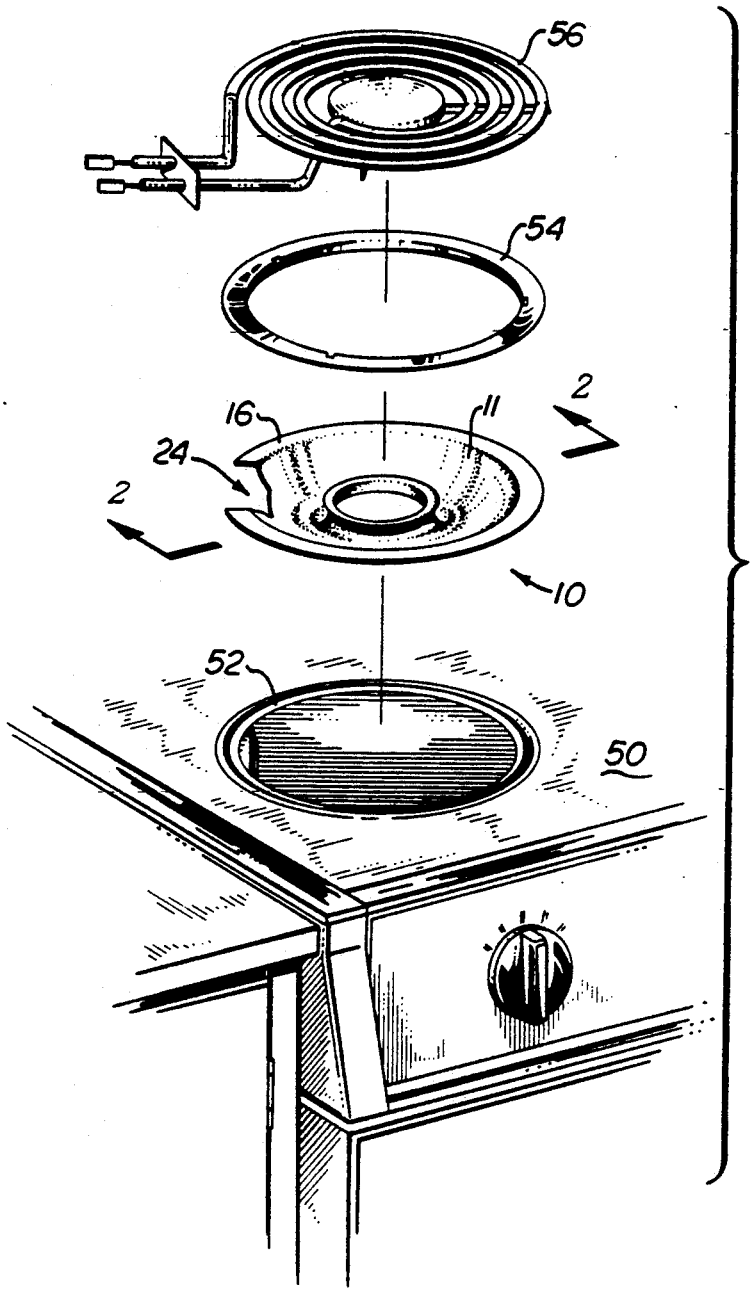
FIG. 1 is an exploded, perspective view of the drip pan assembly of the present invention incorporated in an electric range.

Referring now to FIG. 1, the drip pan 10 can be seen in its best mode as part of a range top heating combination comprising a heating element 56, an optional beauty ring 54, the drip pan 10, and the range 50. It is generally preferable that the drip pan 10 correspond to the dimensions of a conventional drip pan, that being having a bowl 11 diameter substantially equivalent to the range-top heating element receptacle 52, a flange 16 diameter somewhat greater than the receptacle 52 diameter so that flange 16 will rest on the range top 50 and prevent the drip pan from falling into the interior of the range, and a bowl 11 depth no greater than the distance between the range top 50 and the oven compartment (not shown). As is customary with drip pans, the drip pan 10 has a notch 24 to accommodate the terminals 58 of the heating element 56.

As can be seen from FIG. 1, the conventional profile of the drip pan 10 allows it to be retrofitted to a conventional range without any alterations to the range. Furthermore, the conventional profile effectively hides the nature of the drip pan 10 while retaining the aesthetic nature of a conventional drip pan. As also can be seen from FIG. 1, the drip pan 10 cooperates with the conventional elements of a range-top heating element structure to provide a complete structure which allows the heating of a cooking vessel in less time using less energy.

Figure 3:
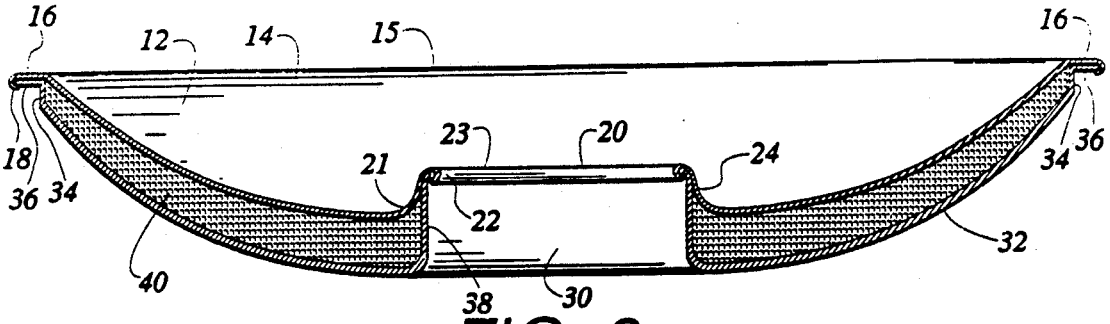
FIG. 3 is a cross-sectional view of the preferred embodiment of the drip pan assembly.

Referring now to FIG. 3, in which the preferred embodiment of the drip pan 10 is shown, it can be seen that the drip pan 10 basically comprises an upper pan 12, a lower pan 30 and insulating material 40 located in an enclosed space formed when upper pan 12 and lower pan 30 are attached together. The upper pan 12 in turn comprises a bowl member 14 having a flange 16 located on the upper periphery of the bowl member and a central opening 21 in the lower, hollow portion of the bowl. The lower pan 30 in turn comprises a bowl member 32 having a cylindrical sleeve member 34 located on the upper periphery of the bowl member 32, the lower edge of the sleeve 34 being integrally attached to the upper edge of the bowl member 32, a flange 36 attached to an extending radially from the upper edge of the sleeve 34, and a central opening 39 located in the bottom hollow of the bowl member 32.

The bowl member 14 of upper pan 12 has a generally shallow concave cross-section. As better shown in FIG. 4, central opening 21 is a circular opening concentric with the center of the bowl, located substantially at the lowest part of the depression of the concave bowl member 14, and being defined by the walls of the bowl member 14. The edge of the bowl member 14 defining opening 21 is generally cylindrical in structure and rises slightly above the lowest plane of the bowl member 14. In other words, there is a somewhat frustro-conical rise 20 in the bottom of the bowl member 14 surrounding the central opening 21. Rise 20 helps prevent any food, liquid or other materials falling into the bowl member 14 from exiting the bowl member 14 through the central opening 21.

At the apex of rise 20, is ridge 22. Ridge 22 generally is rolled inward toward central opening 21 such that edge 22 rolls over, downward and back outward toward the interior of rise 20, thus forming a generally tubular rim 23. Generally a space is left between the edge 22 and the interior surface of the rise 20.

The outer sides of the bowl member 14 rise gradually in a concave shape radially outward from the central opening 21 terminating in an upper peripheral edge located in a plane somewhat above the plane of the central opening 21. The sides of the bowl member 14 generally are nearly vertical as they approach the peripheral edge. Integrally attached to and extending radially in a horizontal direction from the upper peripheral edge of bowl member 14 is a flange 16. One purpose of flange 16 is to support the drip pan 10 within the heating element receptacle 15 on the range top 50. Therefore, flange 16 must have a radial thickness great enough to contact the circular edge or shoulder located on range top 50 defining the receptacle opening 52. The outer peripheral edge of the flange 16 generally is rolled over upon itself so as to form a lip 18 in a plane substantially parallel to, but spaced apart from and below flange 16. Together, flange 16 and lip 18, when taken in cross-section, form a generally "C"-shaped ridge. Lip 18 extends toward, but does not reach, the underside of the bowl member 14, thus allowing access to the space located between flange 16 and lip 18.

Figure 4:
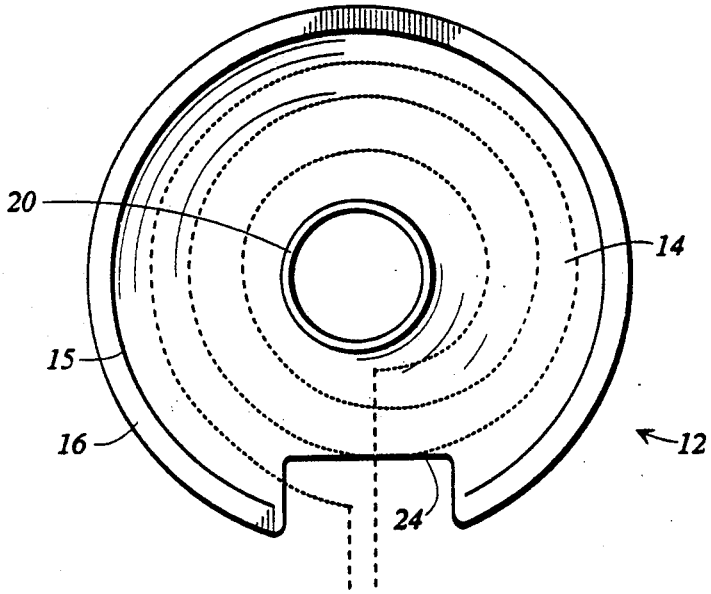
FIG. 4 is a top plan view of the drip pan assembly of FIG. 3.

As also can be seen from FIG. 4, a generally rectangular shaped notch 24 is formed through both flange 16 and bowl member 14. Notch 24 is of such a size and configuration to accommodate heating element terminals 58. The heating element is designated in FIG. 4 as the dashed helical lines. Notch 24 need not be the rectangular shape, but be any shape suitable to accommodate the heating element terminals 58. For example, notch 24 may be an opening in the side wall of the bowl member 14 and flange 16 may be continuous and unbroken around the periphery of the bowl member. Such notch designs are conventional and known in the art.

The lower pan 30 is of the same general shape and size of the upper pan 12 and comprises a similar bowl member 32, central opening 39 and flange 36. Lower pan 30 further comprises a vertical cylindrical sleeve 34 located between flange 36 and bowl member 32 which serves the purpose of extending the side wall and height of the bowl member 32 when compared to the bowl member 14 of upper pan 12. The lower edge of the sleeve 34 is integrally attached to the upper peripheral edge of bowl member 32 and acts as an extension thereof. The upper edge of sleeve 34 is integrally attached to flange 36, flange 36 extending radially in a horizontal direction from the upper edge of sleeve 34.

Bowl member 32 has the same general concave curvature and diameter of bowl member 14, and central opening 39 has the same general diameter as central opening 21.

Central opening 39 is defined by a slight rise in the bowl member 32 resulting in the formation of an interior, generally vertical cylinder 38 rising upward from the hollow depression of bowl member 32. The rise formed by cylinder 38 is slightly greater in height than the rise formed by rise 20 and terminates in an upper circular edge.

Flange 36 of lower pan 30 generally is a flat, planar, horizontal member integrally attached to and extending radial from the upper edge of sleeve 34. The outer radial edge of flange 36 generally has no unusual or noticeable features. The thickness of flange 36 generally is equivalent to or somewhat less than the thickness of the distance between flange 16 and lip 18 and generally has a radial diameter somewhat less than that of flange 16.

Lower pan 30 also includes a notch substantially identical to notch 24 to accommodate the heating element terminals 58. The notch in the lower pan 30 should correspond in shape and size to the notch 24; that is, if notch 24 is rectangular notch, the notch in lower pan 30 also should be a rectangular notch, and if the notch 24 is an opening through the side of bowl member 14, leaving flange 16 intact, the notch in the lower pan 30 also should be an opening leaving flange 36 intact. In general, the edge of notch 24 has the same shape and configuration as described for edge 22 and ridge 23, that being rolled over to form a generally tubular ridge. The edge of the notch in the lower pan is of the same shape and configuration as the upper edge of cylinder 38, that being a generally featureless edge.

The upper pan 12 generally is made of a heat conducting material, such as aluminum or another metal. The lower pan 30 generally is made of a material which does not conduct heat so as the prevent heat from emanating out of the bottom of the drip pan 10. The lower pan 30 generally is made of a heat resistant material, so as to withstand the temperatures of a cooking range, which is flexible enough to cooperate with the upper pan 12. It should be noted that although the materials described above are the best mode contemplated by the inventor, the exact materials are not important and any material suitable for use in such environment are appropriate and identifiable by one skilled in the art.

Insulating material 40, such as fiberglass, asbestos, or any other conventional insulating material appropriate to the particular environment, is placed in the bowl member 32 of lower pan 30. Insulating material 40 should only be placed within the bowl member 32 and should not cover central opening 39 or flange 36 or the notch. Thus, insulating material 40 generally is of a donut shape.

Upper pan 12 is then placed on top of the insulting material 40 and, therefore, within bowl member 32 of lower pan 30. Central opening 21 should correspond with central opening 39, notch 24 should correspond with complimentary notch in the lower pan 30, and flange 16 should correspond with flange 36. Upper pan 12 should be forced down on to the insulating material 40 such that the upper edge of cylinder 38 fits within the space created between the edge of ridge 23 and the outer side of rise 20. The edge of cylinder 38 may be attached to the edge of ridge 23 or the outside of rise 20 by any conventional means such as welding or by crimping the tubular ridge 23 against the upper edge of the cylinder 38. Flange 36 is inserted within the space created between flange 16 and lip 18. In order to insert flange 36 into this space, it may be necessary to squeeze sleeve 34 inwardly toward the center of the drip pan 10 such that flange 36 can slide over lip 18 into the area between lip 18 and flange 16. Flange 36 can be secured in this area by any conventional means, including friction, welding, or by crimping lip 18 upward against flange 36, thus forcing flange 36 against flange 16.

Figure 5:
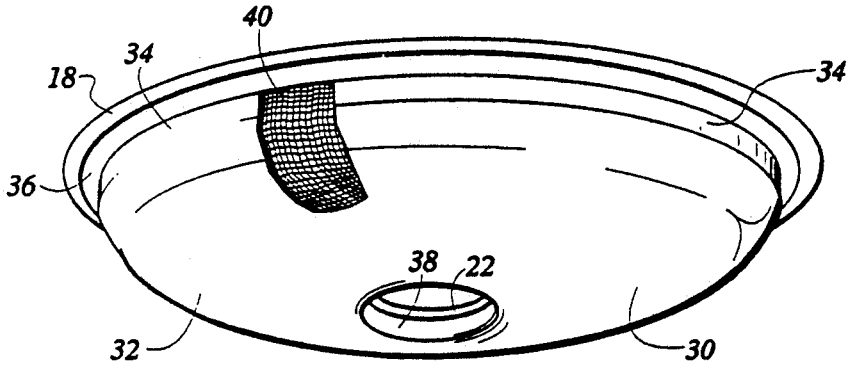
FIG. 5 is a perspective elevational view of the bottom of the drip pan assembly of FIG. 3.

The complete structure of drip pan 10 can be seen in FIGS. 3 and 5 depicting the lower pan 30, the insulating material 40 and the upper pan 12 in a completed, functional form. Drip pan 10 now is ready for use and may be inserted into the receptacle 52 of a typical range 50 to replace the conventional drip pan. As is obvious, the outer diameter of the drip pan 10 should be such that it can easily be retrofitted to existing ranges. Further, the total depth of the drip pan assembly 10, from flange 16 to the bottom of bowl member 32 should be such that the drip pan 10 sits easily within existing range top heating element receptacles 52 similar to conventional drip pans.

The insulating material 40 prevents heat radiated downward from the helical heating element 56 from being radiated out into the air surrounding the drip pan assembly 10. Instead, heat radiated into the drip pan assembly 10 is radiated back up toward the cooking vessel located on the heating element 56, thereby decreasing both heating time and the energy required to heat the cooking vessel. Insulating material 40 is preferably a deformable foraminous mat which conforms to both the shape of the lower surface of bowl member 14 of upper pan 12 and the upper surface of bowl member 32.

As discussed initially, the cooperation between the present invention and a conventional range top can be seen in FIG. 1. The drip pan assembly 10 is placed within the heating element receptacle 52 of an electric range 50. Flange 16 should rest upon the shoulder defining the opening of receptacle 52. An optional beauty ring 54, typically made of chrome, or shiny aluminum or other polished metal, is placed over flange 16. Over the beauty ring 54, heating element 56 is inserted. Heating element terminals 58 are inserted through notch 24 and the cooperating notch in the lower pan 30 and plugged into a power receptacle (not shown) within the range 50.

Figure 2:
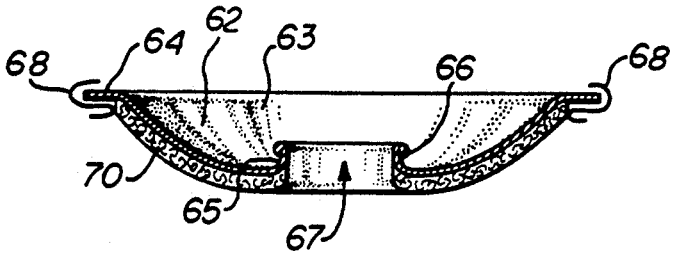
FIG. 2 is a cross-sectional view of an alternative embodiment of the drip pan assembly of the present invention.

An alternative embodiment of the present invention is presented in FIG. 2. This alternative embodiment, denoted generally by the numeral 60, comprises a single shallow circular pan to which insulation is clipped. Pan 62 is similar in shape and configuration to upper pan 12 and comprises a bowl member 62, a flange 64 integrally attached to and radially extending horizontally from the upper periphery of the bowl member 62, and a central opening 67 defined by an upwardly extending ridge 65 located concentric with and in the lower depression of the bowl member 62. Ridge 65 is similar to rise 20 of upper pan 12 with the exception that edge 66 is rolled inwardly toward bowl member 62 walls rather than outwardly like edge 22 and ridge 23. Flange 64 is a generally planar, radially horizontal, circular component which is substantially the same size as and which serves the same purpose as flange 16; that is, is wide enough to rest upon the shoulder of the heating receptacle 52. The upper perimeter of the ridge 65 is adjoined by edge 66, which deflects food, liquid and other material back into the bowl and away from the central opening 67. Insulating material 70, substantially identical to insulating material 40, is attached to the lower outer surface of bowl member 62 by any conventional means, such as adhesives or clips. In FIG. 2, a multiplicity of S-clips 68 are located about flange 64 and serve to press the insulation 70 against the outer surface of bowl member 62. Similarly, S-clips 68 along ridge 65 around the periphery of central opening 67 hold insulation 70 in place against the ridge 65.

Drip pan 60 is used in the same manner as drip pan 10, and when drip pan 10 is replaced with drip pan 60 in FIG. 1, it can be seen in an enabling mode. Insulating material 70 is located on the underside of drip pan 60, and is neither viewable from above the range top 50, thus increasing aesthetics, nor exposed directly to the heating element 56, and thus not exposed to any food, liquid, or other matter which may enter central opening 67. Drip pan 60 is made from the same materials as upper pan 12, and insulating material 70 is the same material as insulating material 40.

It will be obvious to those skilled in the art that many variations may be made in the embodiment chosen for the purpose of illustrating the best mode of making and operating the present invention, including the materials of composition and the shapes of the various components, without departing from the scope thereof as defined by the appended claims.

What is claimed is:

1. An insulated drip pan assembly for being disposed beneath a heating element of a stove, comprising:

a first pan comprising a central bowl member having an upper surface and a lower surface;

an insulating member disposed beneath said lower surface of said bowl member; and securing means for securing said insulating member in insulating relationship to said bowl member for arresting the flow of heat away form said lower surface of said bowl member, said securing means comprising a second pan disposed beneath of said insulating material for sandwiching said insulating member between said first pan and said second pan, and means for connecting said second pan to said first pan; wherein said first pan further comprising a first flange protruding outwardly from the lower surface of said bowl member, said second pan further comprising a second flange protruding outwardly from said second pan and being received beneath and secured to said first flange, and said bowl member being provided with an upstanding first annular sleeve in its central portion, said first annular sleeve defining a first central opening and said second pan being provided with an upstanding second annular sleeve in its central portion, said second annular sleeve defining a second central opening, said second annular sleeve protruding through said first central opening and fixed to said first sleeve.

2. The insulated drip pan assembly defined in claim 1, wherein said insulating member is shaped to conform to the lower surface of said bowl member.

3. The insulated drip pan assembly defined in claim 1, wherein said insulating member is a deformable foraminous mat which conforms to the shape the lower surface of said bowl member.

4. The insulated drip pan assembly defined in claim 1, wherein said insulating member extends throughout substantially the entire bottom surface of said pan.

5. An insulated drip pan assembly for being disposed beneath a heating element of a stove, comprising:

a first circular pan comprising a first circular bowl member, a peripheral flange connected to a perimeter of said bowl member, and a lip adjoining said flange and located in a parallel spaced apart relationship with respect to said flange, said first pan comprising a centrally located hollow upstanding cylinder in said bowl, and a substantially C-shaped ridge connected to the perimeter of an opening of said cylinder;

a second circular pan having a second circular bowl member, a sleeve connected to a perimeter of said second bowl member at one sleeve end, and a second flange adjoining the sleeve at the other sleeve end, said second flange located between said first flange and said lip, said second pan further comprising a centrally located, upwardly extending, hollow cylinder in said second bowl member, the perimeter of said cylinder abutting said C-shaped ridge; and an insulating member sandwiched between said first and second pans.

* * * * *